United States Patent [19]

Churchill

[11] 4,130,102

[45] Dec. 19, 1978

[54] ADAPTOR AND CONTROL SYSTEM ARRANGEMENT FOR CONVERTING MULTIPLE CYLINDER CARBURETOR ENGINES FOR SPLIT OPERATION

[75] Inventor: Arthur E. Churchill, Alexandria, Va.

[73] Assignee: George A. Stanford, Marlow Heights, Md. ; a part interest

[21] Appl. No.: 829,974

[22] Filed: Sep. 1, 1977

[51] Int. Cl.[2] ..... F02D 13/06

[52] U.S. Cl. ..... 123/198 F; 261/23 A

[58] Field of Search ..... 123/198 F, 97 B, DIG. 6, 123/DIG. 7; 261/23 A

[56] References Cited

U.S. PATENT DOCUMENTS

| | | | |
|---|---|---|---|
| 2,623,617 | 12/1952 | Snyder et al. | 123/198 FX |
| 2,837,322 | 6/1958 | Thome et al. | 261/23 A |
| 2,919,686 | 1/1960 | Mick | 123/198 F X |
| 2,947,298 | 8/1960 | Dolza | 123/198 F X |
| 2,977,945 | 4/1961 | Cramer | 261/23 A |
| 2,991,053 | 7/1961 | Cramer | 261/23 A |
| 3,071,124 | 1/1963 | Cramer | 261/23 A |
| 3,578,116 | 5/1971 | Nakajima | 123/198 F X |
| 3,698,371 | 10/1972 | Mitsuyama | 123/198 F |
| 4,019,479 | 4/1977 | Garabedian | 123/198 F |
| 4,073,278 | 2/1978 | Glenn | 123/198 F |

*Primary Examiner*—Ira S. Lazarus

*Attorney, Agent, or Firm*—Bacon & Thomas

[57] ABSTRACT

An adaptor having first and second passages is mounted between a two-barrel carburetor and the first and second inlet openings of a two-section intake manifold, and includes an air port. The second passage and the air port are aligned with the second inlet opening and contain interconnected valves operated by a valve motor, arranged so that when one valve is open the other is closed. The valve motor is operated by a control system including a pair of vacuum switches and a holding circuit, in response to vacuum in the first inlet manifold section. The carburetor throttle arm is equipped with a surge compensator connected to operate simultaneously with the valve motor, to change the length of the throttle arm for eliminating power surges when shifting between split and full engine operation.

20 Claims, 7 Drawing Figures

Fig. 1.
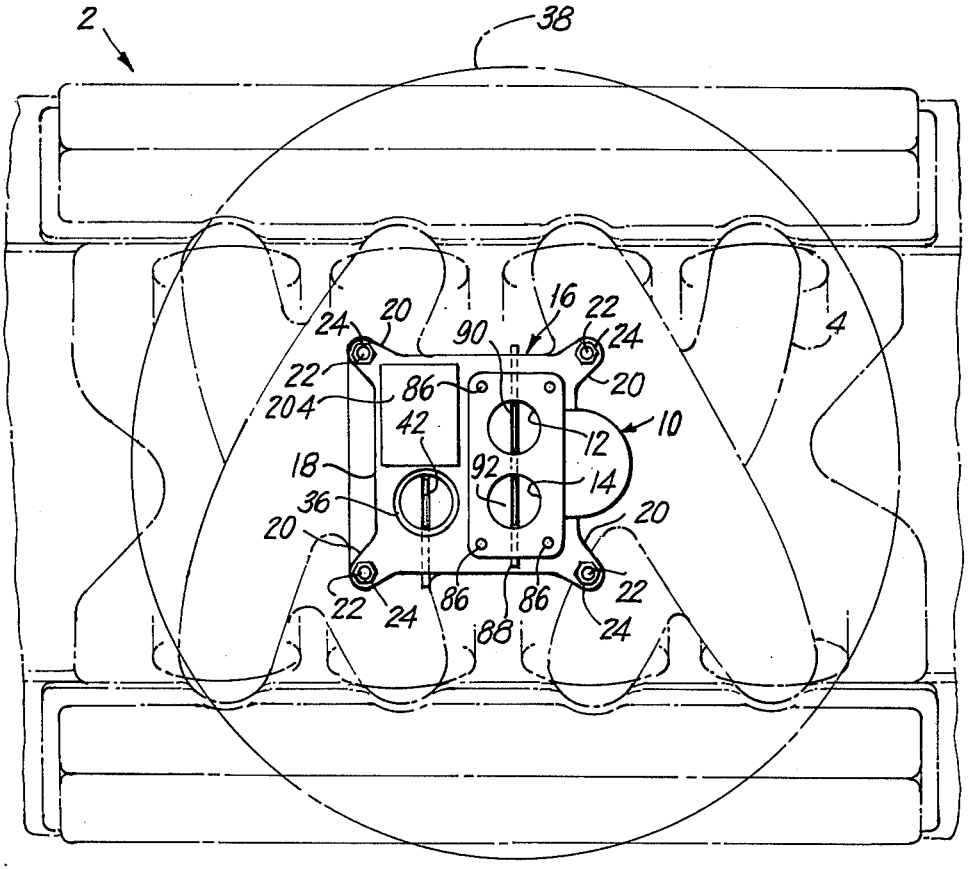
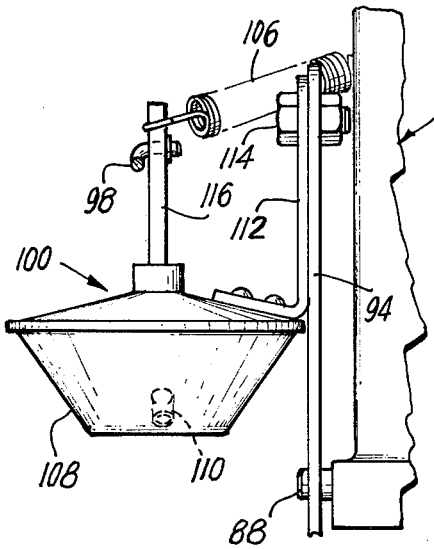
Fig. 5.

PARTIALLY OPEN THROTTLE 8 CYL.

10
16
34
4
8
36
96
98
C
94
100
116
108
110
122
106
88
92
44
32
30
28
46
40
42
54
52
18
50
56

PARTIALLY OPEN THROTTLE 4 CYL.

10
16
34
4
8
36
96
98
C
D
116
94
118
122
100
108
110
106
88
92
44
32
30
28
46
40
42
54
52
18
50
58
60
56

ADAPTOR AND CONTROL SYSTEM ARRANGEMENT FOR CONVERTING MULTIPLE CYLINDER CARBURETOR ENGINES FOR SPLIT OPERATION

BACKGROUND OF THE INVENTION

1. Field of the Invention

The present invention relates generally to arrangements for effecting the so-called split operation of multiple cylinder internal combustion engines used to power motor vehicles and the like, and which utilize conventional carburetors to supply a fuel-air mixture through an intake manifold to the engine cylinders. More particularly, it relates to an assembly and control system for converting existing engines of this type for split operation, designed to provide the driver of the vehicle with a very smooth power curve over the engine operating range, and to significantly reduce overall fuel consumption.

2. Description of the Prior Art.

It has been recognized for many years that the multiple cylinder internal combustion engine of an automobile or the like does does not need to operate at full power under all conditions. Rather, the need for power falls significantly when cruising speeds have been attained, and is minimal when the engine is idling, When all of the cylinders of the engine are operating during such periods of reduced power demand, fuel is in effect wasted. In this time of increasing energy crises, such as waste of fuel is simply unacceptable.

Many years ago it was proposed that this problem be overcome by operating the engine in a so-called split manner, with all of the cylinders in operation only during periods when full or 7 full power demand exists, and with only a portion of the cylinders operating at idle and under conditions of significantly reduced power demand. In this way, fuel consumption during lower power demnd periods can be significantly reduced.

There have been many different proposals for achieving such split engine operation. In the 1930's, early attempts are illustrated by U.S. Pat. Nos. 1,990,808, 2,085,818 and 2,114,655. In the first of these, the engine was simply equipped with a hand-controlled carburetor shut-off valve, operated by the driver when it was desired to cut out a portion of the cylinders. The third patent utilized a simple mechanical linkage to the same end. Both approaches offer a rather crude level of engine control and are totally unsuited to current driving conditions. The second of these patents provided a system operated in response to the generator speed and thus, was an effort at automatic operation in response to load conditions. However, the response with such an arrangement is necessarily very uneven. All of these patents require rather extensive modifications to conventional carburetors, manifolds and other engine components.

Another group of inventors approached the concept of split engine operation through carburetor modfications, in which the system that supplies a fuel-air mixture to the engine is reconstructed to achieve the desired result. typical of these efforts are U.S. Pat. Nos. 2,166,968, 2,362,879, 2,368,012, 2,373,302 and 2,379,288. While this approach is fruitful for new engines, it has limitations when applied to the engines of conventional construction now operating in motor vehicles on our highways. First of all, the cost of new carburetor equipment and allied components can be excessive. Perhaps more importantly, though, it can prove very difficult to mount such new carburetion equipment on today's existing, sophisticated engines, and still obtain fully acceptable operation.

These same problems are inherent in another approach that has been taken to achieveing split engine operation, wherein resort is has to fuel injection equipment, instead of the conventional carburetor for supplying fuel to the engine cylinders. Again, this approach is a valid one for new engine construction, and can produce good results, But it is simply unadaptable for conventional carburetor-type engines now in use. Typical of the inventive efforts in this field are U.S. Pat. Nos. 2,843,098, 2,878,798, 2,918,047, 2,947,298, 2,954,022, 3,270,724, 3,756,205 and 3,765,394.

Recently, another approach has been taken to the problem, wherein selective cylinders of an engine are rendered inoperative by suitable means, rather then dealing with the supply of fuel-air mixture to a bank of cylinders. Typical of this approach is the invention shown in U.S. Pat. No. 3,578,116, wherein selected branch passage of the inlet manifold are equipped with valve devices operable to effect the isolation of their associated cylinders. While effective, such approaches again require extensive modifications to engine components, largely limiting their application to new engine construction.

There are millions of internal combustion engines now in use, fitted with conventional carburetors to provide a fuel-air mixture to their cylinders. The fuel consumption of these engines could be significantly reduced if they could be converted to split engine operation, thereby contributing greatly to solving the world energy crisis. But to be both practical and acceptable, the conversion to split operation must be achieved with simple equipment and installable by the average mechanic at minimum cost. Further, the resulting engine must provide a very smooth power curve to the driver, or it will cause apprehension and will not be accepted. There is no known, acceptable apparatus for achieving such conversions at the present time and this, the purpose of the present invention is to meet this need.

Turning to the matter of providing a smooth power curve, a part of the problem is to deal effectively with the period of time during which a multiple cylinder engine shifts from full to partial operation, and vice versa. It has long been recogized that this brief moment causes a quick change in power, and unless it is accommodated for, it can cause the vehicle to jump or jerk for an instant, creating apprehension in the driver.

The usual approach that is taken to compensate for this quick change in power in a motor vehicle is to provide for an automatic adjustment in the linkage between the accelerator pedal and the throttle on the carburetor, as is proposed in U.S. Pat. Nos. 2,386,669, 2,421,800, 2,623,617, 2,875,742 and 2,919,636. In each instance the linkage is modified in such a manner that it would be difficult to retrofit an existing motor vehicle. Moreover, in some past approaches the resulting adjustable linkage is unduly complicated and does not provide fully smooth operation.

There is thus need for an improved, automatic surge compensator arrangement that can be easily utilized on existing engines, and which will assure a smooth power curve, The present invention also addresses this need.

SUMMARY OF THE INVENTION

The present invention is especially designed to convert an existing multiple cylinder internal combustion motor vehicle engine for split engine operation, and is readily adaptable to those engines which have dual intake manifolds that utilize conventional two and four barrel carburetors. In the invention, the two intake manifold sections are separate entities, and one section is in operation at all times when the engine is running. The cylinders associated with the second engine manifold section are alternated between running and non-running status by controlling the admission of fuel-air mixture thereto, in response to the value of the vacuum measured in the first intake manifold section.

The apparatus of the invention includes an adaptor that is mounted over the dual intake manifold inlet openings, and upon which a conventional two-barrel carburetor is mounted in such a way that the two barrels thereof are totally separate. The adaptor has two passages therethrough, one aligned with the discharge of each carburetor chamber, which serve to connect the carburetor discharges with the intake manifold inlet openings. The adaptor passage associated with the first carburetor chamber is unobstructed and allows this section of the carburetor to function normally for supplying a fuel-air mixture to the set of cylinders associated therewith.

The adaptor also has an air port which connects with the second manifold inlet opening, the upper end of which communicates with the atmosphere, preferably through the usual air cleaner fitted on the carburetor intake. Two butterfly valves are carried by the adaptor, the first being located in the second passage therein, and the second in the air port. The two valves are interconnected for simultaneous operation and are operated by a vacuum valve motor.

When it is desired to have full engine operation, the two butterfly valves of the adaptor are operated so that the first is open, and the second closed. Under this condition, a fuel-air mixture is supplied to the second set of cylinders through the second chamber of the carburetor, in the usual manner. When it is desired to initiate split engine operation by deactivating the second set of cylinders, the valve motor is operated to reserve the position of the butterfly valves.

When the butterfly valves are in their split engine mode, the passage from the second carburetor chamber is blocked, whereas the air port is open to supply ample amounts of air to the cylinders of the second set. This air flow totally relieves vacuum in the second manifold section, resulting in no air-fuel mixture being drawn through the second carburetor chamber. At the same time, an excess of air is passed through the second set of cylinders into the exhaust manifold, where it serves to dilute the exhaust gases. This additional air flow can also be used to ensure further combustion of the exhaust gases from the first set of cylinders, to further improve engine performance.

When full engine operation is again wanted, the butterfly valves are again reversed. Immediately thereafter upon the creation of vacuum in the second manifold section, the flow of a fuel-air mixture will again commence, and the second set of cylinders will produce power. This immediate response is important to eliminate hesitation in the engine power curve, and is a particular benefit of the arrangement of the invention.

By utilizing a conventional carburetor in the manner of the invention, the fuel-air mixture is always available in the second carburetor chamber, ready to respond to a drawing vacuum. This ensures nearly instantaneous response. By contrast, in those devices of the past, wherein the flow of fuel to the carburetor is cut off to achieve split engine operation, there is an inherent, undesirable and conceivably dangerous time lag involved between when full engine operation is commanded and the flow of a fuel-air mixture can resume.

The adaptor of the invention, then, enables a conventional dual intake manifold engine to be readily converted for split operation. The valve motor is operated by a control system that in turn is operated by the value of the vacuum in the first intake manifold system, the control system being based on a pair of vacuum switches connected through a holding circuit to a solenoid valve that controls the supply of vacuum to the valve motor.

One of the vaccum switches is set to respond to a low manifold vacuum and the other, to a high vaccum value. When power demand falls sufficiently during engine operation to cause the vacuum in the first manifold section to rise above the preset value of the "HIGH" vacuum switch, the solenoid valve is operated to switch the butterfly valves for split engine operation. Thereafter, the holding circuit is effective to maintain split engine operation, even though the vacuum fluctuates above and below the "HIGH" value. But when the vacuum fails sufficiently to operate the "LOW" vacuum switch, the engine will be returned to full operation. The control circuit assures smooth engine operation, without a constant fluttering between full and split engine operation.

In order to accommodate the power surge that occurs when switching from split to full engine operation, the throttle arm of the invention is in effect made adjustable in length, and is operated by a vacuum compensator motor. The surge compensator motor is connected to automatically retard the throttle when the engine is shifted to full operation, providing a very smooth power curve to the operator of the vehicle. Moreover, by utilizing the adjustable throttle arm to vary the throttle linkage, another unique benefit is derived over anything known before. Specifically, operation of the surge compensator under idle conditions causes no measurable change in throttle position, but as power is increased, the effect on the throttle increases also. Thus, the surge compensator of the invention automatically adjusts to different power conditions.

The apparatus of the invention also includes a temperature switch connected into the control circuit to prevent split engine operation until the engine has warmed to operating tempertures. Similarly, a transmission switch is connected into the circuit to prevent split engine operation while underway until a desired cruising speed has been achieved.

Another feature of the invention is that the control system is arranged to provide for shifting to split engine operation whenever the carburetor is in an idle mode. A switch is made out of the contact between the throttle arm and the idle screw so that when the arm comes to rest on the idle screw, split operation will commence. The switch is immediately opened when the accelerator is depressed.

It is the principle object of the present invention to provide apparatus for converting a conventional carburetor equipped motor vehicle engine for split engine operation, whereby to achieve significant reductions in fuel usage and provide a very smooth power curve.

A further object is to provide an adaptor for converting an engine to split engine operation, while utilizing conventional carburetor equipment to supply a fuel-air mixture to the engine cylinders.

Another object is to provide a control system for a split engine assembly, designed to ensure smooth engine operation over a wide range of power demand, and automatic shifting of the engine to split operation when at idle.

Yet another object is to provide a vacuum switch arrangement for controlling split engine operation, in response to the value of vacuum in the operating intake manifold section.

A still further object is to provide a surge compensator for eliminating the power surge normally occurring when an engine shifts from split to full operation, and which is readily adptable for use on existing conventional engines.

It is also an object to provide a surge compensator that provides increasing compensation as the engine operates at greater power levels.

Another object is to provide apparatus for converting a conventional motor vehicle engine for split engine operation that is economical, and which can be installed by the average mechanic.

Other objects and many of the attendant advantages of the invention will become readily apparent from the following Description of the Peferred Embodiment when taken in conjunction with the attached drawings.

BRIEF DESCRIPTION OF THE DRAWINGS

FIG. 1 is a diagrammatic fragmentary plan view of an eight cylinder conventional carburetor engine, showing the adaptor of the invention mounted on the dual intake manifold and a two-barrel carburetor mounted thereon, the conventional components of the engine being shown in phantom lines for purposes of clarity;

FIG. 5 is an enlarged fragmentary side elevational view, taken on the line 5—5 of FIG. 4, and showing details of the adjustable throttle arm of the surge compensator;

DESCRIPTION OF THE PREFERRED EMBODIMENT

Figure 2:
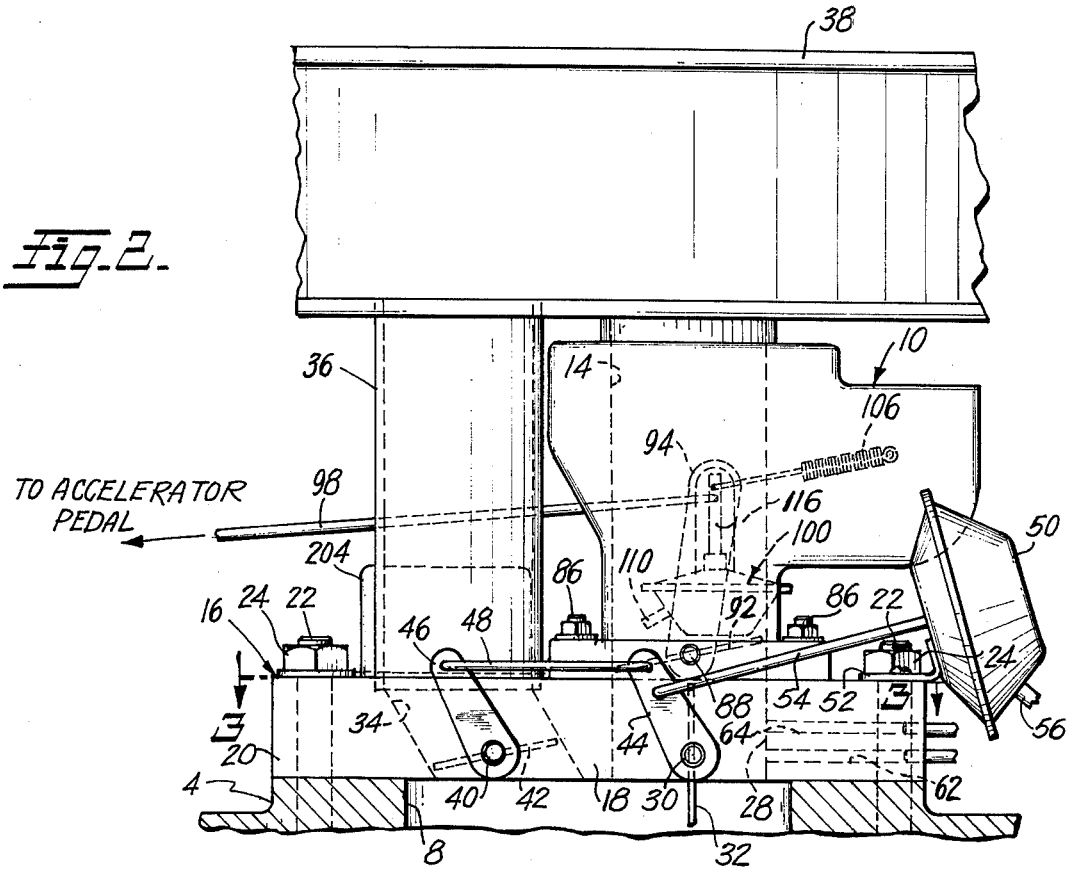
FIG. 2 is an enlarged fragmentary right side elevational view of the engine of FIG. 1, showing in more detail the arrangement of the adaptor, the carburetor, and associated components.

Referring now to the drawings, a conventional eight cylinder internal combustion engine is indicated generally at 2, and includes a conventioanl dual-plane, two-section intake manifold 4 that supplies a fuel-air mixture to the engine cylinders. The two section intake manifold serves to divide the eight cylinder engine into two sets of cylinders, four to each set.

It is to be understood that while the invention will be described in connection with an eight cylinder engine, it can also be employed with other multiple cylinder engines having, say, four or six cylinders, wherein an intake manifold is utilized that divides the cylinders into sets. The design of the manifold itself is not too material provided separate operating sections are present, which is conventionally done. Usually, the dual-plane manifold sections will each supply cylinders located on opposite sides of the engine, to ensure balanced engine operation.

The intake manifold 4 includes first and second inlet openings 6 and 8, respectively, which are conventionally constructed to be separate from each other. The first inlet opening 6 supplies a first set of engine cylinders, and the second opening 8 provides the second, other set of cylinders. The fuel-air mixture is conventionally supplied to the intake manifold openings 6 and 8 by a carburetor having either two or four barrels, and usually the barrels are interconnected to provide balanced flow to the two sides of the engine.

In the invention, a two barrel carburetor 10 is employed, having first and second chambers 12 and 14, respectively. The carburetor 10 is conventional in every respect, except that it must be mounted so that the two chambers 12 and 14 are completely separate from each other. The manner in which this is accomplished will vary depending upon the design of the carburetor. Usually, mixing between chambers is provided by a domed recess in the base of the carburetor that interconnects the discharge openings of the chambers. This domed recess can be easily divided into two separate sections by a gasket, or other suitable means.

The carburetor 10 is not mounted directly on the inake manifold 4, as would normally be the case. Rather, an adaptor 16 is inserted therebetween, the adaptor being designed to enable split engine operation.

Figure 3:
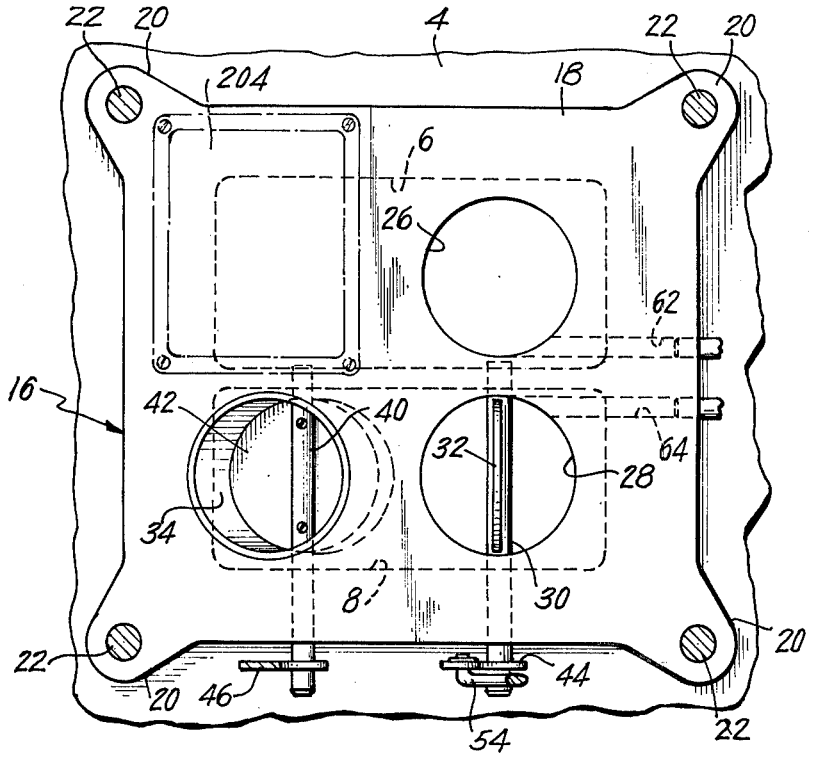
FIG. 3 is a horizontal sectional view of the adaptor, taken on the line 3—3 of FIG. 2.

The adaptor 16, as is best shown in FIGS. 1-3, includes a plate 18 having four ears 20 thereon, positioned to correspond to the locations of the usual carburetor mounting bolts 22 mounted on the upper face of the intake manifold 4. The ears 20 have holes therethrough for reception of the bolts 22, ad the adaptor is secured to the intake manifold by nuts 24. A suitable gasket or sealing compound is employed between the adaptor and the upper face of the manifold 4, about the perimeters of the inlet openings 6 and 8.

The adaptor 16 includes first and second spaced, vertical ports or passages 26 and 28 extending therethrough, which serve to connect the chambers 12 and 14 of the carburetor 10 with the first and second inlet openings 6 and 8 of the intake manifold 4, respectively. A first shaft 30 is mounted in a cylindercal bore provided in the adaptor 16, and extends diametrically across the second passage 28. A first butterfly valve element 32 is carried by the shaft 30, and the latter is rotatable to open and close the valve.

Spaced from the second passage 28 in the plate 18 is an air port 34, arranged to also open into the second intake manifold inlet opening 8. The air port 34 is angled away from the passage 28 so that the upper end thereof is spaced from the carburetor 10, and said upper end is preferably connected by a short conduit 36 to the usual air cleaner 38 provided on the carburetor. If desired, however, the upper end of the air port can be fitted with a separate air cleaner, or in some instances it might simply be left open.

A second shaft 40 is rotatably mounted in a second bore provided in the adaptor plate 18, and carries a second buttefly valve 42 that is effective to close the air port 34. The shafts 30 and 40 carry operating arms 44 and 46 on their outer ends, which are interconnected by a link 48 so that the two butterfly valves 32 and 42 will be simultaneously operated. A valve motor 50 is mounted on the adaptor plate 18 by a bracket 52, and includes a piston 54 that is connected to the operating arm 44. In the preferred embodiment of the invention, the valve motor 50 is vacuum operated, and is supplied with vacuum through a hose 56. The valve motor 50 is arranged so that when an operating vacuum has been applied thereto, the piston 54 will shift to the right in FIG. 2 to close the first butterfly valve 32; when the vacuum is relieved, the valve motor has a diaphragm 58 biased by a spring 60 that will move the piston in the opposite direction to again open the butterfly valve 32.

As is best shown in FIG. 2, the first and second butterfly valves 32 and 42 are arranged at substantially right angles to each other, so that when one is open, the other is closed. The butterfly valves 32 and 42 must be so arranged in their respective cylindrical pasages that they will open and close properly and in particular, so that they will essentially close off their respective passages when closed. It should be understood that the operating arms 44 and 46 could be connected by gears instead of the link 48, if so desired. The important feature of that both butterfly valves 32 and 42 operate at the same time.

The adaptor plate 18 is also includes first and second bleed passages 62 and 64 leading to the first and second passage 26 and 28, respectively, for bleeding vapors into the intake manifold 4 from the crankcase, in accordance with pollution control specifications. The passages 62 and 64 are connected to a conduit 66 leading from the crankcase by a Y-fitting 68, passing through a P.C.V. valve 70. The Y-fitting 68 includes legs 72 and 74. The leg 72 is connected directly with the normally operating first passage 26, while the leg 74 is connected with the second passage 28 through a flow control valve 76 operated by a vacuum control valve motor 78, which draws vacuum through a conduit 80 from the intake manifold section associated with the second passage 28 (the right side of the engine in FIG. 1). The valve motor 78 includes a diaphragm 82 biased by a spring 84 and is so arranged as to close the flow control valve 76 when there is no vacuum in the right section of the intake manifold, whereby the bleed passage 64 is also closed. The bleed passages 62 and 64 take the place of the similar passages normally provided in the carburetor 10, which are simply plugged and assure proper operation of the positive crankcase ventilation system.

The carburetor 10 is secured directly to the top face of the adaptor plate 18 by the usual mounting screws 86, with a suitable gasket or sealing compound being utilized therebetween to ensure that the passages 26 and 28 and their chambers 12 and 14 are isolated from each other. A throttle shaft 88 extends through the carburetor 10 and carries throttle butterflies 90 and 92 thereon, for the chambers 12 and 14, respectively. The outer end of the throttle shaft 88 has a throttle arm 94 rigidly connected thereto for operating the butterfly valves 90 and 92 as a pair.

The throttle arm 94 is connected with the accelerator pedal 96 of the motor vehicle through a linkage 98 and a surge compensator 100. When the butterfly valves 90 and 92 are in position for engine idle, the throttle arm 94 rests in engagement with an idle screw 102 carried by a bracket 104 on the carburetor body, in the usual manner. When the accelerator pedal 96 is depressed, the linkage 98 is effective to pivot the throttle arm 94 away from the screw 102 against the force of the carburetor return spring 106 to thereby increase the flow of fuel-air mixture to the cylinders for increased engine power.

The throttle arm 94, the linkage 98 and the return spring 106 used with the conventional carburetor already on an automobile or other motor vehicle need not be changed or abandoned in order to employ the surge compensator 100 of the invention. To the contrary, the surge compensator 100 is designed to be fully compatible with these elements and at the same time, to function in a manner that will smooth out the transition from split to full engine operation so that there is effectively no impact felt at the acceleration pedal 96.

Referring in particular to FIGS. 4–10, the surge compensator 100 includes a motor 108 that in the preferred embodiment of the invention is vacuum operated, and which is supplied with vacuum through a hose 110. The surge compenstor motor 108 is mounted on a bracket 112, which is fixed to the throttle arm 94 by a bolt 114. The point of connection to the throttle arm 94 is at the upper end thereof, where the linkage 98 and the return spring 106 are normally connected. To make the installation, the linkage 98 and the return spring 106 are disconnected from the throttle arm 94, and the bracket 112 is simply secured thereto by the bolt 114.

The surge compensator motor 108 includes an extendable piston 116, which is moved between retracted and extended positions by a diaphragm 118 and return spring 120 contained within the motor housing 122. When vacuum is applied to the motor 108, the piston 116 retracts, and when the vacuum terminates, the return spring 120 will cause it to extend.

The surge compensator 108 in effect becomes the new throttle arm in the invention, as will be readily appreciated, similar in all respects to the throttle arm 94 except that it is extendable. The throttle linkage 98 and the return spring 106 are connected to the upper end of the piston 116 and thereafter, the carburetor 10 is operated as usual by the accelerator pedal 96.

Figure 6:
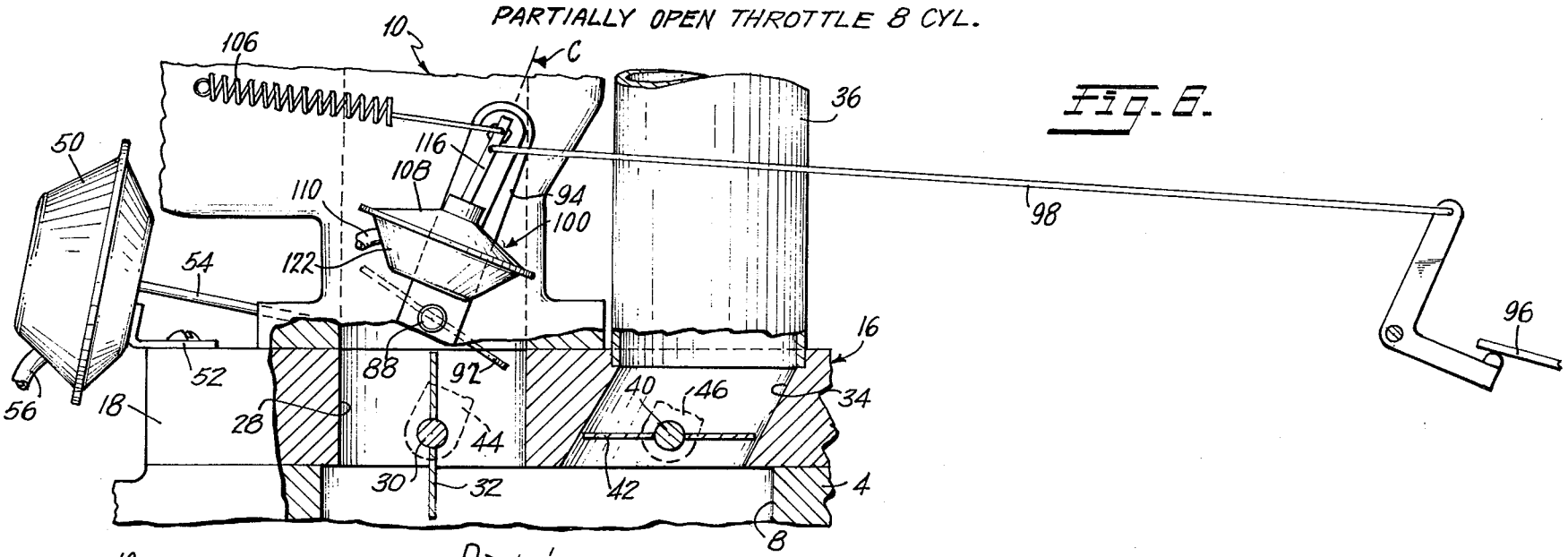
FIG. 6 is a diagrammatic fragmentary elevational view similar to FIG. 4, but showing the position of the butterfly valves and the adjustable throttle arm during eight cylinder operation of the engine, the throttle arm being in an extended position.
Figure 7:
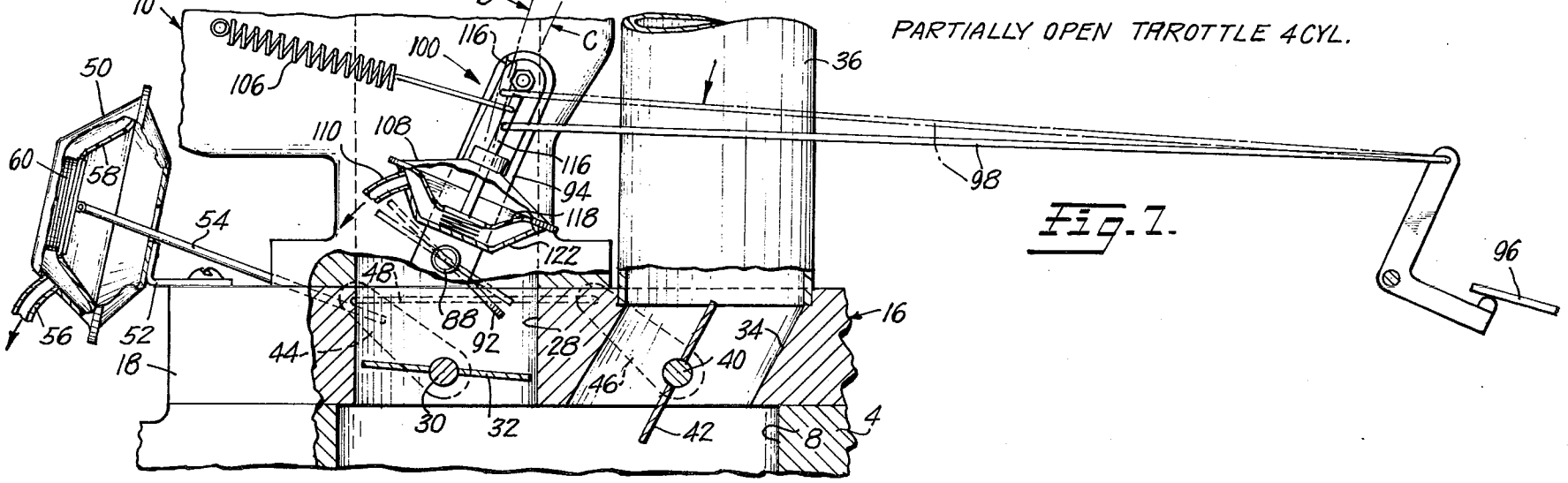
FIG. 7 is a diagrammatic fragmentary elevational view similar to FIG. 6, but showing the position of the components for split engine operation, with the adjustable throttle arm in a retracted position.

The manner in which the unique surge compensator 100 of the invention functions can best be understood by a comparison of FIG. 6 with FIG. 7. In FIG. 6, the adaptor 16 is shown in a position wherein the first butterfly valve 32 is open, so that the engine is operating on all eight cylinders. Note that in this condition, the piston 116 of the surge compensator 100 is extended and that the centerline C of the throttle arm 94 is inclined at an angle to the vertical.

Referring now to FIG. 7, the assembly is shown immediately after the adaptor 16 has been operated to shift the engine to split operation. At the same time, vacuum is supplied to the surge compensator motor 108 and the piston 116 is moved to its retracted position. All of this occurs with no motion on the accelerator 96 being necessary under cruising conditions. In fact, a major purpose of the surge compensator 100 is to prevent any unusual pressure or lack thereof from occurring on the accelertor pedal 96 because of the shift to split engine operation or return. The manner in which this is accomplished will be appreciated by examining FIGS. 6 and 7.

Looking now at FIG. 7, it will be noted that retraction of the piston 116 will act to change the inclination of the centerline C of the throttle arm 94 by an incremental angle D, which in trun will cause a shift in the angle of the throttle butterflies 90 and 92 sufficient to compensate for the shift from one mode of engine operation to the other. While small, this change in the angle of inclination of the throttle arm 94 is significant from the viewpoint of supplying fuel-air mixture to the engine, to compensate for the shift in modes. But at the same time, the effect of the small change in length of the piston 116 is substantially zero on the lengthy linkage 98, which merely pivots about its connection with the pedal 96 by an amount so small as to normally be imperceptible to the operator having a foot on the pedal 96.

Because of the geometry of the throttle butterfly valve arrangement, the linkage 98, and the throttle arm 94, the surge compensator 100 of the invention offers another advantage. When the mode of engine operation is shifted from full to split while the engine is at idle, the butterfly valves are of course open. At the same time, little load is on the engine and the flow of fuel-air mixture is minimal. Thus, the constriction of the carburetor passages caused by a sight movement of the throttle butterflies is of little effect under these conditions.

Under cruising conditions, however, wherein the chambers 12 and 14 are already partially closed and the engine is especially sensitive to the flow of air-fuel mixture, the slight movement of the throttle butterfly valves is more significant, increasingly so as power demand and engine speed increase. Thus, the surge compensator of the invention tends to adjust for engine speed and power demand, providing a very smooth power curve under substantially all operating conditions, At the same time, it is designed for easy installation on nearly any vehicle, with no extensive modifications being required.

It will of course be appeciated that when the engine is shifted from split to full operation, the piston 116 will again be extended. This results in a slight cutback in the supply of fuel-air mixture to compensate for the surge that will normally occur when shifting to full operation. The result is again very smooth operation and substantially no impact at the pedal 96.

The amount of travel required for the piston 116 is small and can be determined for different types of engines. Usually, the travel is set for maximum smoothness in the operating speed range of from 40 to 60 MPH, which is the range in which maximum surge and maximum impact on the pedal 96 will normally, occur, absent the surge compensator 100. If desired, the piston 116 can be constructed to be adjustable in length so that different engines can be easily accommodated. This can be done by simply installing a nut on the diaphragm 118 and threading the lower end of the piston 116 so that it is threadably engageable with the nut. Other adjustable arrangements are also possible.

Figure 4:
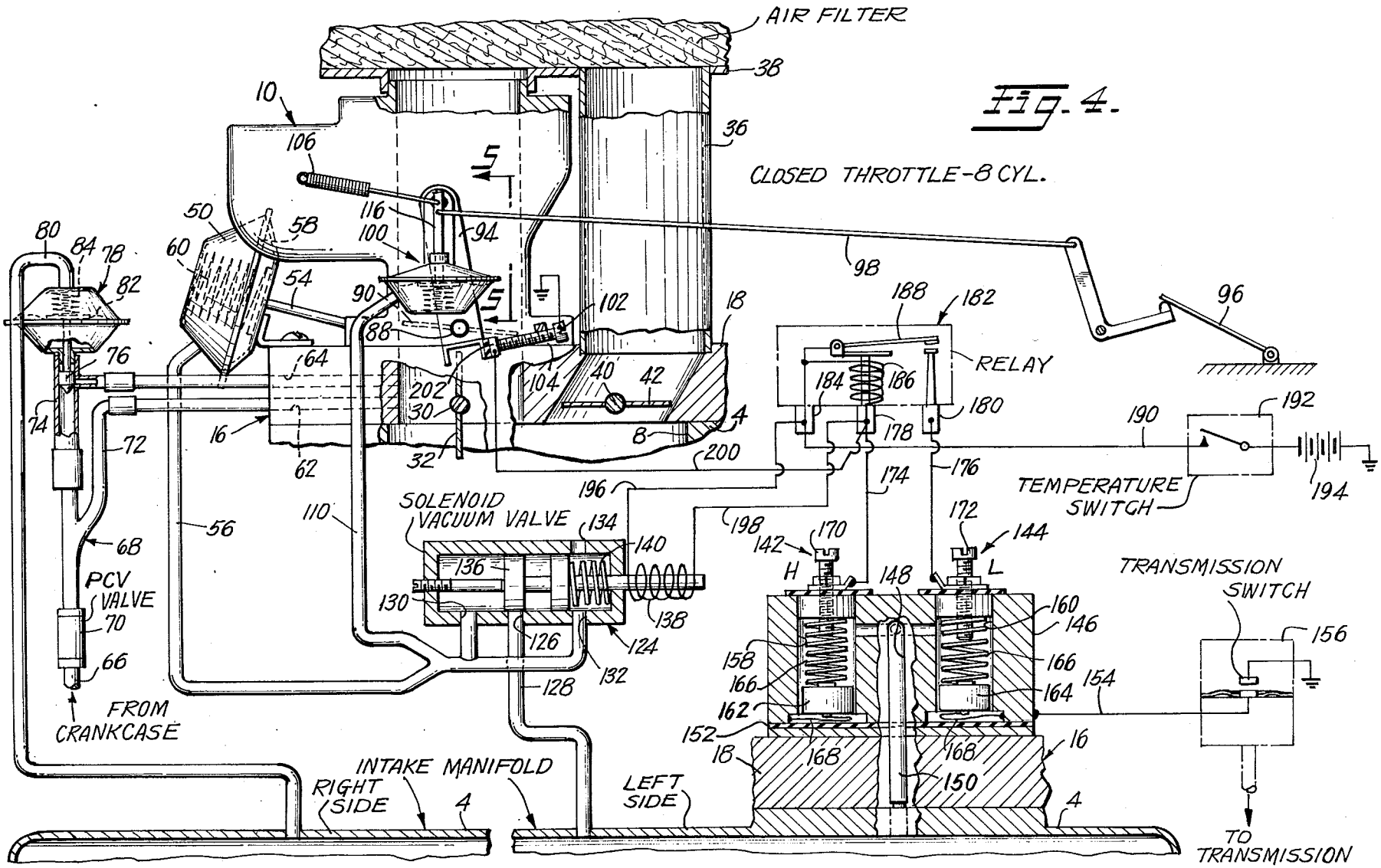
FIG. 4 is a diagrammatic view, partly in section, illustrating in a schematic manner the mechanical and electrical circuit arrangement of the invention for effecting alternate full and split engine operation.

The adaptor 16 and the surge compensator 100 are both controlled by a control system that is responsive to the value of vacuum measured in the first or permanently operating intake manifold section, which is the left side of the engine as viewed in FIG. 1 and in FIG. 4. It has been found that this vacuum well reflects the operating conditions of the engine, whether in a split or full operational mode, and it is thus a nearly ideal controlling agent.

The control system of the invention includes a solenoid valve 124, which includes an inlet port 126 connected by a conduit 128 to the first intake manifold section, a vacuum supply port 130, and a relief port 132. While it is to be understood that the three-way solenoid valve 124 can be of any acceptable construction, the valve shown schematically in FIG. 4 includes a valve body 134 containing a spool 136 operated by a solenoid coil 138. When energized, the solenoid coil 138 is effective to connect the vacuum supply port 130 with the inlet port 126. When de-energized, the spool 136 is shifted by a spring 140 to connect the vacuum supply port 130 with the relief port 132.

The hoses 56 and 110 from the valve motor 50 and the surge compensator motor 108 are connected to both the vacuum supply port 130 and the relief port 132 of the solenoid valve 124. Thus, whenever the solenoid coil 138 is energized, vacuum will simultaneously be supplied to the motors 50 and 108, effecting shifting of the engine to split operation and retraction of the piston 116 at substantially the same time. Similarly, when the solenoid coil is de-energized the engine will shift to full operation and the piston of the surge compensator 100 will be simultaneously extended.

The control system of the invention is based on a pair of vacuum operated switches 142 and 144, the switch 142 being intended to close when a preselected "HIGH" vacuum value is sensed, and the switch 144 being intended to open when a preselected "LOW" vacuum value is reached. While the design of the switches 142 and 144 can be varied, in the preferred embodiment of the invention both are mounted within a housing 146, the housing 146 preferably being mounted on the adaptor plate 18, and thus on the intake manifold 4.

The housing 146 is provided with a central vacuum supply passage 148, which is placed in communication with the first side of the intake manifold 4 through an aligned passage 150 in the adaptor plate 18. The housing 146 is insulated from the adaptor plate 18 by insulation 152 and is electrically connected to ground by a lead 154 through a transmission operated switch 156.

The housing 146 contains two chambers 158 and 160 for the "HIGH" and "LOW" switches 142 and 144, respectively, both containing pistons 162 and 164 biased springs 166 and grounded to the housing 146 by leads 168. The upper ends of the chambers 158 and 160 are closed and have insulated, adjustable contacts 170 and 172, respectively, threadably mounted therein. Vacuum is supplied to the upper ends of both chambers from the central supply passage 148.

When the engine is operating, both of the chambers 158 and 160 will have the vacuum of the first section of the intake manifold placed thereon. The adjustable contact 170 of the "HIGH" switch 142 is set so that the piston 162 will engage the contact 170 only when the value of the vacuum exceeds a preselected "HIGH" value, say about 15 to 18 inches of mercury. Naturally, at this time the "LOW" switch 144 will already be closed, with its piston 164 in engagement with the contact 172. The importance of the "LOW" switch 144, however, is to indicate when engine vacuum falls below a preselected "LOW" value, say from 5 to 8 inches of mercury, at which time it will open. Leads 174 and 176 connect the "HIGH" and "LOW" switches 142 and 144 to the second and third contacts 178 and 180, respectively, of a relay 182 that is part of a holding circuit arrangement.

The switches 142 and 144 are designed to operate so that when the "HIGH" switch 142 closes, the engine will shift to split operation. This shift will usually result in a drop in engine vacuum, which will thus cause the "HIGH" switch 142 to open again. Thus, if the "HIGH" switch alone controlled the solenoid valve 124, the engine would flutter back and forth between split and full engine modes, a most unsatisfactory method of operation.

To avoid this from occurring, the two switches are utilized in conjunction with a holding circuit. With this arrangment, and under normal cruising conditions, once the engine has shifted to split operation because the "HIGH" switch 142 has closed, it will remain in that mode until the "LOW" switch 144 opens, indicating that the engine should shift back to full operation. In this way a range is established for split operation of the engine, the limits of which are easily set merely by adjusting the response values of one or both of the switches 142 and 144.

The relay 182 includes a first contact 184, and a solenoid coil 186 is connected between the first and second contacts 184 and 178. A relay switch 188 is operated by the solenoid coil 186 and when closed, connects the first contact 184 with the third contact 180.

The first contact 184 is connected by a power lead 190 through a temperature switch 192 to the battery or other power supply 194. The temperature switch 192 is controlled by the operating temperature of the engine and will not close until a satisfactory temperature has been reached. Thus, the switch 192 effectively controls the application of power to the split engine system, so that it will be allowed to operate only when the engine is at an acceptable operating temperature.

The solenoid core 138 of the solenoid valve 124 is connected by leads 196 and 198 to the first and second contacts 184 and 186 of the relay 182, respectively. Finally, a lead 200 connects the second contact 178 with an insulated contact plate 202 mounted on the throttle arm 94, in position to engage the idle screw 102. The idle screw 102 is itself connected to ground and this at any time the throttle arm 94 is engaged with the idle screw 102, the second contact 178 will be connected to ground. Similarly, the instant the accelerator pedal is lightly depressed to move the throttle arm away from the idle screw 102, this grounding circuit will be broken.

The system of the invention operates in the following manner. When the engine is cold and at rest, the first butterfly valve 42 will be open and the piston 116 will be extended. Thus, the carburetor 10 will function normally for starting purposes. Further, until the engine has warmed sufficiently to close the switch 92, the control system for the adaptor 16 will be inoperative.

When the temperature switch 92 closes, energy will be supplied to the contact 184. If the driver's foot is not on the accelerator pedal 96 thereafter, so that the throttle arm 94 is in engagement with the throttle screw 104, the circuit through the relay coil 186 will be completed, and the solenoid valve coil 138 will be activated to shift the engine to split operation. This will occur thereafter during the entire period of engine operation, so that whenever the throttle arm 94 shifts to an idle position, split operation will occur. The instant the accelerator pedal 96 is depressed to disengage the throttle arm 94 from the screw 102, the circuit will be broken and mandated split operation of the engine will no longer occur from this source.

With this arrangement, the engine will automatically shift to split operation when the foot is taken from the accelerator, say at a stop sign or the like. Thus, fuel usage will be substantially reduced in stop-and-go driving conditions.

Assume now that the engine is warm, so that the temperature switch 92 is closed and that the accelerator pedal 96 has been depressed to increase power output. After the vehicle has attained a preselected operating speed, the transmission switch 156 will close. Transmission switches of this type are well known and in the instance of an automatic transmission, usually operate in response to pressure from the transmission that increase with increasing speed.

With the transmission switch 156 closed, the two vacuum switches 142 and 144 are now operative to control the adaptor 16. When cruising speed has been reached, vacuum drawn from the left side of the intake manifold 4 will reach a preselected "HIGH" value, and the switch 142 will close; the "LOW" switch 144 will, of course, already have closed by this time.

The closing of the "HIGH" switch 142 establishes the flow of energy from the power supply 94, through the contact 184, the contact 178, and the lead 154 to ground, thereby energizing the coil 186 and the solenoid valve coil 138. The result is that the adaptor 16 is operated to effect split engine operation, and the relay switch 188 is closed.

When the relay switch 188 closes, a new circuit to ground is established through the contact 180, the lead 176, the "LOW" switch 144, and the lead 154. This provides a holding circuit, which will remain effective to assure split engine operation even after the value of the measure intake manifold vacuum falls enough to open the "HIGH" switch 142. The holding circuit will remain in being until the vacuum falls sufficiently to also open the "LOW" switch 144, upon which occurrance the engine will automatically revert to full operation as the flow of energy to the solenoid valve 124 is terminated.

It will be appreciated that with the holding circuit arrangement, the engine will be allowed a range of operation while in the split mode, during which the value of the measure vacuum can fluctuate extensively. Once the vacuum level falls below a given, preselected value, however, the engine will return automatically to full operation, and full power will be available. With this arrangement, the engine can be driven up and down hills, and through most traffic conditions, while operating in a split mode.

Turning to the settings for the vacuum switches 142 and 144, the "HIGH" switch 142 will normally be set within a range of from about 15 to about 18 inches of mercury. If it is set much above this, the engine may be too slow to shift into a split mode during cruising, resulting in a waste of fuel. Below this range, the engine may not provide enough power when going up a steep hill before shifting to split operation.

The range for the "LOW" switch 144 should be from about 5 to about 8 inches of mercury. Below 5 inches, undue strain may be placed on the engine before full power is restored, except perhaps for light weight automobiles. Generally, the power of the engine relative to the weight of the vehicle must be taken into account in setting the two switches, with a higher powered vehicle utilizing higher settings on the "HIGH" switch 142.

The surge compensator 100 of course functions during a shift from one mode of engine operation to the other, to provide a smooth power curve. It should also be noted that the shorter effective throttle arm length resulting during split engine operation will provide more rapid acceleration action, and added benefit to this arrangement.

The vacuum switches 142 and 144 and the electrical components of the circuit are all conveniently mounted on the adaptor plate 18 and can be covered by a cover 204, as shown in FIG. 1. Thus, the adaptor 16 is essentially a self-contained unit that can be easily installed on an existing engine, with electrical connections being made thereto with a minimum of skill required.

It is to be understood that the invention is subject to modifications. For example, while it is preferred that the valve motor 50, the surge compensator motor 108 and the motor 78 all be vacuum operated, it is apparent that electrical solenoid motors could be substituted therefor. In this instance, the solenoid control valve 124 would be eliminated. Instead, the electrical leads 196 and 198 would simply be connected to the contacts of the three substituted soleniod motors, as is readily understood.

Further, is the manufacturer wished to go to the expense, it would be possible to incorporate the adaptor plate 18 into a single casting with a carburetor body, if desired. The result would be a single combined two barreled carburetor and adaptor until that would be substituted for the existing two to four barrel carburetor on an engine and otherwise, the invention would function in the same manner.

It was earlier mentioned that the supply of additional air through the idle cylinder can help to reduce problems of air pollution in the exhaust manifold. It would also be possible to enhance this effect by making modifications to the manifold so that such excess air is injected into the exhaust manifold outlets of the operating cylinders, thereby achieving further combustion of any unburned fuel in the hot exhaust vapors.

Obviously, many other modifications and variations are also possible, without departing from the invention as shown and described.

I claim:

1. In a motor vehicle including a multiple cylinder internal combustion carburetor engine having an intake manifold for supplying a fuel-air mixture to the engine cylinders, said intake manifold being divided into first and second sections having separate inlet openings, a first set of the engine's cylinders being connected with the first section of said intake manifold and a second set of said cylinders being connected with the second of said sections, a transmission connected with said engine, and an accelerator pedal, an adaptor and control system arrangement for effecting either full or split operation of said engine, comprising:

an adaptor mounted on said intake manifold, and including first and second passages aligned with the inlet openings of said first and said second manifold sections, respectively, and an air port in communication with said second manifold sections;

first valve means mounted in said first passage of said adaptor, and movable between open and closed positions;

second valve means mounted in said air port in said adaptor, and movable between open and closed positions;

means interconnecting said first valve means with said second valve means for effecting substantially simultaneous operation thereof, and arranged so that said second valve means will open when said first valve means is closed, and vice versa;

valve motor means connected to operate said interconnected first and second valve means;

a carburetor mounted on said adaptor and having separate first and second chambers aligned with said first and said second passages, respectively, said carburetor including a throttle shaft, a throttle arm for operating said throttle shaft, and an idle screw engageable by said throttle arm;

linkage means connecting said throttle arm with said accelerator pedal; and control means with said valve motor means for operating the same in response to the valve of vacuum within said first intake manifold section, and arranged to close said first valve means when the vacuum in said first intake manifold section rises above a first, preselected value, and to open said first valve means when the vacuum in said first intake manifold section falls below a second, preselected value;

said control means including a holding circuit operable to hold said first valve means in its closed position after it has been closed in response to vacuum in said first inlet manifold section exceeding said first preselected value, until after said vacuum value falls below said second preselected value.

2. In a motor vehicle as recited in claim 1, wherein said valve motor means is vacuum operated, and wherein said control means includes a control valve arranged to operate said vacuum operated valve motor means.

3. In a motor vehicle as recited in claim 1, wherein said control means further includes:

a solenoid arranged to operate said valve motor means to close said first valve means, when energized;

a power supply;

a first vacuum operated switch connected with said first inlet manifold section to receive vacuum therefrom, and arranged to close when the value of said vacuum rises above a preselected "HIGH" value, and to open when the value of said vacuum falls below said "HIGH" value;

a second vacuum operated switch also connected with said first manifold section to receive vacuum therefrom, and arranged to open when the value of said vacuum falls below a preselected "LOW" value, said "HIGH" value being substantially greater than said "LOW" value;

first lead means connecting said first and said second vacuum operated switches to ground;

a holding relay; and second lead means connecting said first and said second switches, said holding relay, and said solenoid with said power supply, and arranged in a first circuit whereby when said first circuit is energized and said engine is operating above idle speed, said solenoid will remain unenergized while said first and said second switches remain open because of low vacuum, and said solenoid will become energized when said second switch is closed by vacuum exceeding said "HIGH" value, and will remain energized until both said first switch and said second switch open because the value of the vacuum has fallen below said "LOW" value.

4. In a motor vehicle as recited in claim 3, including additionally:

a third switch formed between said throttle arm and said idle screw, arranged to close when said throttle arm engages said idle screw; and third lead means connecting said third switch with said power supply, ground, and said solenoid, and arranged in a second circuit whereby when said second circuit is energized and said third switch is closed, said solenoid will be energized.

5. In a motor vehicle as recited in claim 4, including additionally:

a transmission switch connected in said first lead means and with said transmission, and arranged to close when automobile has accelerated to a preselected operating speed.

6. In a motor vehicle as recited in claim 4, including additionally:

a temperature switch connected in said second lead means, and arranged to prevent the flow of energy into both of said first and said second circuits until after the operating temperature of said engine has reached a preselected value.

7. In a motor vehicle as recited in claim 3, wherein said first and said second vacuum switches are adjustable, for selecting said "HIGH" vacuum value and said "LOW" vacuum value.

8. In a motor vehicle as recited in claim 3, wherein said valve motor means is vacuum operated, and wherein said solenoid operates a control valve connected between said vacuum operated valve motor means and said first inlet manifold section.

9. In a motor vehicle as recited in claim 1, wherein said adaptor is made integral with said carburetor.

10. In a motor vehicle as recited in claim 1, including additionally:

surge compenstion means connected between said throttle arm and said linkage means, and arranged to be operable by said control means for effecting a fractional rotation of said throttle shaft when said motor means is operated to shift said first valve means from its open to its closed position, and vice versa.

11. In a motor vehicle as recited in claim 10, wherein said surge compensation means includes:

a surge compensator attached to said throttle arm, and including a piston movable between retracted and extended positions, and a surge compensator motor means connected with said piston for effecting movements thereof;

said linkage means being connected to said surge compenstor piston; and said surge compemstor motor means being connected with said control system, whereby it is activated to retract said piston when said first valve means is closed, and to extend said piston when said first valve means is opened.

12. In a motor vehicle as recited in claim 11, wherein said surge compensator motor means is vacuum operated.

13. In a motor vehicle including a multiple cylinder internal combustion carburetor engine having an intake manifold for supplying a fuel-air mixture to the engine cylinders, said intake manifold being divided into first and second sections having separate inlet openings, a first set of the engine's cylinders being connected with the first section of said intake manifold and a second set of said cylinders being connected with the second of said sections, a transmission connected with said engine, and an accelerator pedal, an adaptor and control system arrangement for effecting either full or split operation of said engine, comprising:

an adaptor mounted on said intake manifold, and including first and second passages aligned with the inlet openings of said first and said second manifold sections, respectively, and an air port in communication with said second manifold section;

first valve means mounted in said first passage of said adaptor, and movable between open and closed positions;

second valve means mounted in said air port in said adaptor, and movable between open and closed positions;

means interconnecting said first valve means with said second valve means for effecting substantially simultaneous operation thereof, and arranged so that said second valve means will open when said first valve means is closed, and vice versa;

valve motor means connected to operate said interconnected first and second valve means;

a carburetor mounted on said adaptor and having separate first and second chambers aligned with said first and second passages, respectively, said carburetor including a throttle shaft, a throttle arm for operating said throttle shaft, and an idle screw, said throttle arm being engageable with said throttle screw;

a surge compensator secured to said throttle arm, and including a piston movable between extended and retracted positions, and surge compensator motor means connected to operate said piston;

linkage means connecting said surge compensator piston with said accelerator pedal, and including means for biasing throttle arm toward engagement with said idle screw; and control means connected with said valve motor means and said surge conpensator motor means for operating the same in response to the value of vaccum within said first intake manifold, said control means including:

a solenoid arranged to operate said valve motor means and said surge compensator motor means, when energized;

a power supply;

a first vacuum operated switch connected with said first inlet manifold section to receive vacuum therefrom, and arranged to close when the value of said vacuum rises above a preselected "HIGH" value, and to open when the value of said vacuum falls below said "HIGH" value;

a second vacuum operated switch also connected with said first manifold section to receive vacuum therefrom, and arranged to open when the value of said vacuum falls below a preselected "LOW" value, said "HIGH" value being substantially greater than said "LOW" value;

first lead means connecting said first and said second vacuum operated switches to ground;

a holding relay; and second lead means connecting said first and said second switches, said holding relay, and said solenoid with said power supply, and arranged in a first circuit whereby when said first circuit is energized and said engine is operating above idle speed, said solenoid will remain unenergized while said first and said second switches remain open because of low vacuum, and said solenoid will become energized when said second switch is closed by vacuum exceeding said "HIGH" value, and will remain energized until both said first switch and said second switch open because the value of the vacuum has fallen below said "LOW" value.

14. In a motor vehicle as recited in claim 13, including additionally:

a third switch formed between said throttle arm and said idle screw, arranged to close when said throttle arm engages said idle screw;

third lead means connecting said third swtich with said power supply, ground and said solenoid, and arranged in a second circuit whereby when said second circuit is energized and said third switch is closed, said solenoid will be energized.

15. In a motor vehicle as recited in claim 14, including additionally:

a transmission switch connected in said first lead means and with said transmission and arranged to close when said automobile has accelerated to a preselected operating speed, and a temperature switch connected in said second lead means, and arranged to prevent the flow of energy into both of said first and second circuits until after the operating temperature of said engine has reached a preselected value.

16. In a motor vehicle as recited in claim 14, including additionally:

venting means connecting the crankcase of said engine with said first and said second passages of said adaptor;

third valve means connected between said venting means and said second passage, and operable to close off flow of said second passage; and venting valve motor means connected with said third valve for operating the same, and connected in said control system to be operated by said solenoid when the latter is energized.

17. In a motor vehicle as recited in claim 16, wherein said valve motor means for operating said first and second valve means, said surge compensator valve motor means, and said venting valve motor means are all vacuum operated from a common control valve connected with said first inlet manifold section, said control valve being operable by said solenoid.

18. In a motor vehicle including a multiple cylinder internal combustion engine having means for effecting split engine operation of said engine, said means including an operating solenoid, a control system for controlling the supply of energy to said operating solenoid, comprising:

a power supply;

a first vacuum operated switch connected with the inlet manifold of said engine to receive vacuum therefrom, and arranged to close when the valve of said vacuum rises above a preselected "HIGH" value, and to open when the value of said vacuum falls below said "HIGH" value;

a second vacuum operated switch also connected with said inlet manifold, and arranged to open when the value of said vacuum falls below a predetermined "LOW" value, said "HIGH" value being substantially greater than said "LOW" value;

first lead means connecting said first and said second vacuum operated switches to ground;

a holding relay; and second lead means connecting said first and said second switches, said holding relay and said operating solenoid with said power supply, and arranged in a first circuit whereby when said first circuit is energized and said engine is operating, said solenoid will remain unenergized while said first and said second switches remain open because of low vacuum, and said solenoid will become energized when said second switch is closed by vacuum exceeding "HIGH" value, and will remain energized until both said first switch and said second switch open because the value of the vacuum has fallen below said "LOW" value.

19. In a motor vehicle as recited in claim 18, wherein said engine includes a carburetor having a throttle arm and an idle screw engageable by said throttle arm, and wherein said control system further includes:

a third switch formed between said throttle arm and said idle screw, arranged to close when said throttle arm engages said idle screw; and third lead means connecting said third switch with said power supply, ground, and said solenoid, and arranged in a second circuit whereby when said second circuit is energized and said third switch is closed, said solenoid will be energized.

20. In a motor vehicle including a multiple cylinder internal combustion carburetor engine arranged for split engine operation, a surge compensator arrangement operable upon the shifting of said engine from full to split operation, and vice versa, said engine including a carburetor having a throttle arm, an accelerator pedal, and linkage means for connecting said throttle arm with said accelerator pedal, and said surge compensator including:

a surge compensator secured to said throttle arm of said carburetor, and including a piston movable between extended and retracted positions, and a motor means operable to effect movement of said piston between said positions;

said linkage means being connected with the free end of said piston; and said motor means being connected to be operated simultaneously with the shifting of said engine from full operation to split operation, and vice versa.

* * * * *